US011719395B2

(12) United States Patent
Chen

(10) Patent No.: US 11,719,395 B2
(45) Date of Patent: Aug. 8, 2023

(54) WHITE AND WARM WHITE LED SYNCHRONOUS INTELLIGENT LIGHT STRING ASSEMBLY

(71) Applicant: JIANGSU LEDCO LIGHTING TECH CO., LTD., Yancheng (CN)

(72) Inventor: Genhai Chen, Yancheng (CN)

(73) Assignee: JIANGSU LEDCO LIGHTING TECH CO., LTD., Yancheng (CN)

( * ) Notice: Subject to any disclaimer, the term of this patent is extended or adjusted under 35 U.S.C. 154(b) by 0 days.

(21) Appl. No.: 17/277,604

(22) PCT Filed: Jun. 1, 2020

(86) PCT No.: PCT/CN2020/093783
§ 371 (c)(1),
(2) Date: Jul. 8, 2022

(87) PCT Pub. No.: WO2021/082436
PCT Pub. Date: May 6, 2021

(65) Prior Publication Data

US 2022/0356999 A1 Nov. 10, 2022

(30) Foreign Application Priority Data

Oct. 30, 2019 (CN) ..... 201911045552.3

(51) Int. Cl.
*F21S 4/22* (2016.01)
*F21V 23/00* (2015.01)

(52) U.S. Cl.
CPC ..... *F21S 4/22* (2016.01); *F21V 23/003* (2013.01)

(58) Field of Classification Search
CPC ..... F21S 4/22; F21V 23/003
See application file for complete search history.

(56) References Cited

U.S. PATENT DOCUMENTS

2003/0198048 A1* 10/2003 Frederick ..... F21S 4/10 362/249.01
2015/0102736 A1 4/2015 Yan
(Continued)

FOREIGN PATENT DOCUMENTS

CN 108282918 A 7/2018
CN 108347804 A 10/2019
(Continued)

*Primary Examiner* — Bryon T Gyllstrom
(74) *Attorney, Agent, or Firm* — Medler Ferro Woodhouse & Mills PLLC

(57) ABSTRACT

Disclosed is a white and warm white LED synchronous intelligent light string assembly, which includes a white LED chip and a warm white LED chip arranged inside the light bead, and the control IC can control different flashing modes of the LED chips after receiving commands. One end of the IP44 plug is connected to a 24-230V power supply, and the other end of the plug is connected to a fuse for current limitation, a varistor for voltage control, a filter for filtering out noise and separating signals, and a filter circuit for passing the low frequencies and attenuating the high frequencies. Outputs of the filter circuit are respectively connected to an input of the MOSFET and a DCDC transformer. The DCDC transformer outputs a direct current with an altered voltage to a driver and an IRF. The IRF is connected with a program module, a remote-control module and a WiFi & Bluetooth module, and the signal output by the IRF passes through the driving module, both of outputs of the driving module and the DCDC transformer are connected to an input of MOSFET while an output of MOSFET is connected to one end of the main wire. The present disclosure achieves simultaneous control of a plurality of light strings.

8 Claims, 6 Drawing Sheets

(56) References Cited

U.S. PATENT DOCUMENTS

| | | | | |
|---|---|---|---|---|
| 2016/0323972 | A1* | 11/2016 | Bora | H05B 47/11 |
| 2017/0094746 | A1* | 3/2017 | Xiong | H05B 45/48 |
| 2020/0200343 | A1* | 6/2020 | Chen | H05B 47/19 |
| 2021/0029794 | A1* | 1/2021 | Weiss | F21V 23/003 |
| 2021/0352791 | A1* | 11/2021 | Tham | F21V 21/16 |

FOREIGN PATENT DOCUMENTS

| | | | |
|---|---|---|---|
| CN | 111093305 | A | 5/2020 |
| CN | 111132409 | A | 5/2020 |
| WO | 2019148523 | A1 | 8/2019 |
| WO | 2019148524 | A1 | 8/2019 |

* cited by examiner

WHITE AND WARM WHITE LED SYNCHRONOUS INTELLIGENT LIGHT STRING ASSEMBLY

TECHNICAL FIELD

The present disclosure relates to the technical field of decorative lighting, in particular to a white and warm white LED synchronous intelligent light string assembly.

BACKGROUND ART

White and warm white LED synchronous intelligent light string assembly is one of the main decorations for Christmas, and indispensable decorations for consumers, festivals, culture exchanges, cultural events and lighting projects for public area nightscape.

SUMMARY

Technical Problem

However, the available light string assemblies on the market are not so handy to control and color switching thereof is usually performed by manually operating the program in the control box, which fail to adapt flexibly to variations in demand. Furthermore, the structure thereof is too simple to achieve a desired curtain-like or array-like decorative effect or to heighten the festival atmosphere.

Solution to the Problem

Technical Solution

The present disclosure aims to solve the above-mentioned technical problems to some extent.

Given this, in order to address the above technical problems, the present disclosure provides a white and warm white LED synchronous intelligent light string assembly, the light string includes: general light string/icicle light/curtain light/net light. The white and warm white LED synchronous intelligent light string assembly has an outstanding effect. The white and warm white LED is characterized by being controlled by an intelligent power supply to achieve the intelligent light string synchronization effect. The function switching of the synchronization effect of the intelligent light string assembly can be performed through a remote control.

In order to address the above technical problems, the present disclosure provides a white and warm white LED synchronous intelligent light string assembly, which includes an intelligent power supply, a plurality of light strings and a main wire, wherein the plurality of light strings are connected in parallel to the main wire, a male joint and a female joint are respectively arranged on each end of the main wire, the intelligent power supply includes a plug, a controller, and a female terminal of a power wire that are connected in sequence by electric wires, and the female terminal of the power wire is connected to the male joint, and a first end of the plug is connected to a 24-230V power supply, a second end of the plug is sequentially connected to the controller's filter for filtering out noise and separating signals and a filter circuit for attenuating high frequencies and passing low frequencies, outputs of the filter circuit are respectively connected to an input of a MOSFET and a DCDC transformer, the DCDC transformer outputs an direct current with an altered voltage to the driver and the IRF which is connected to a program module, an input synchronous command of the program module for controlling the white and warm white LED synchronous intelligent light string assembly is converted to an output signal after being processed by the IRE, and the output signal arrives to the input of the driving module through the heat dissipation component, further arrives to the input of the MOSFET and then to the plurality of light strings, with outputs of the driving module and the DCDC transformer connected to the input of the MOSFET.

In an embodiment, the IRF is connected to a remote-control module and a WiFi & Bluetooth module.

In an embodiment, synchronous switch of the plurality of light strings is performed by the remote-control module and the WiFi & Bluetooth module through a wireless terminal.

In an embodiment, the light string comprises a general light string, an icicle light, a curtain light or a net light.

In an embodiment, each of the plurality of light strings includes a plurality of white and warm white LED diodes connected in series, each of the plurality of white and warm white LED diodes includes a LED bulb and a PC housing, a chip is arranged inside the LED bulb and the LED bulb is capsulated in the PC housing by an epoxy resin.

In an embodiment, each of the plurality of white and warm white LED diodes has an outer diameter of 3 mm, 4 mm, 5 mm or 8 mm.

In an embodiment, the plug is an IP44 plug

Beneficial Effects of the Invention

Beneficial Effects

The technical effects that can be achieved by this present disclosure are as follows: the program module, the remote-control module and the WiFi & Bluetooth module are connected in parallel to the IRF. The program module, the remote control module and the WiFi & Bluetooth module are all equipped with switches. Any one of the four modules is turned off to form a closed circuit so as to change the color of the light string.

BRIEF DESCRIPTION OF THE DRAWINGS

Description of Drawings

Figure 1:
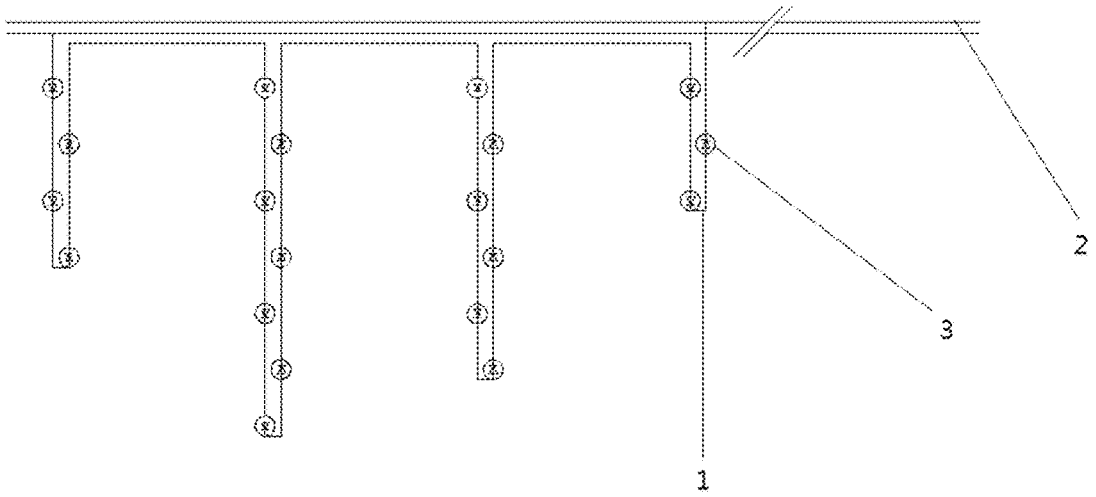
Figures 1, 2:
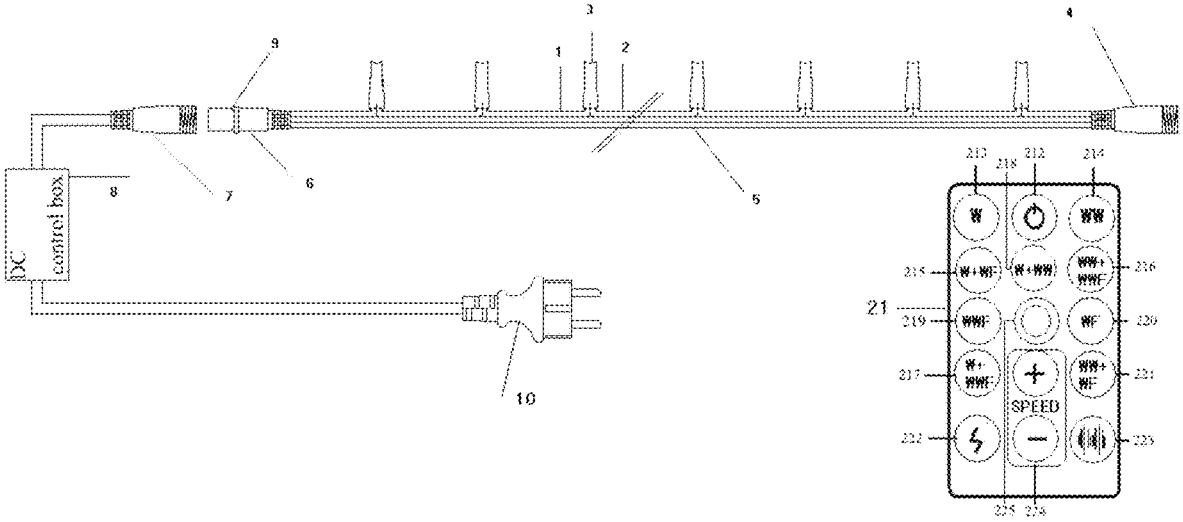
Figure 2:
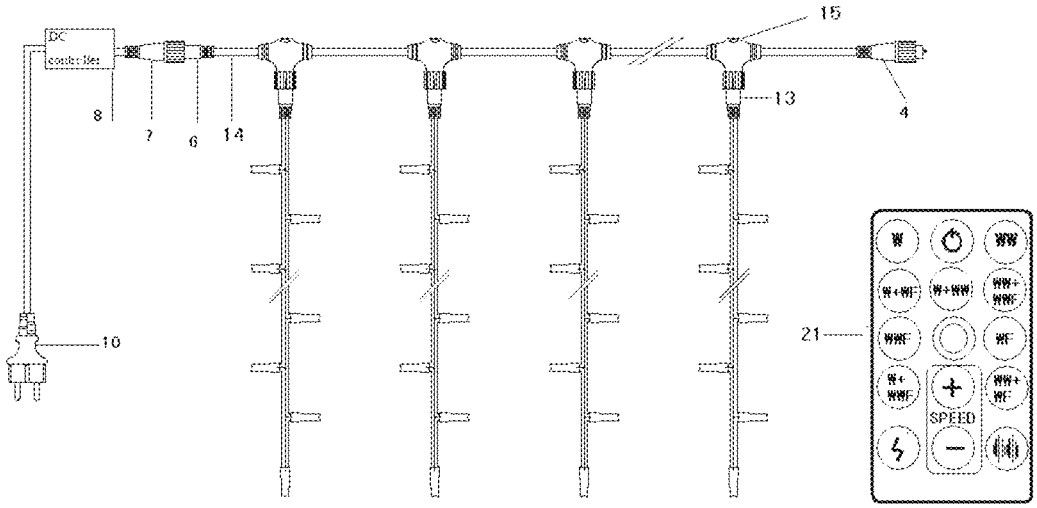
Figures 2, 3:
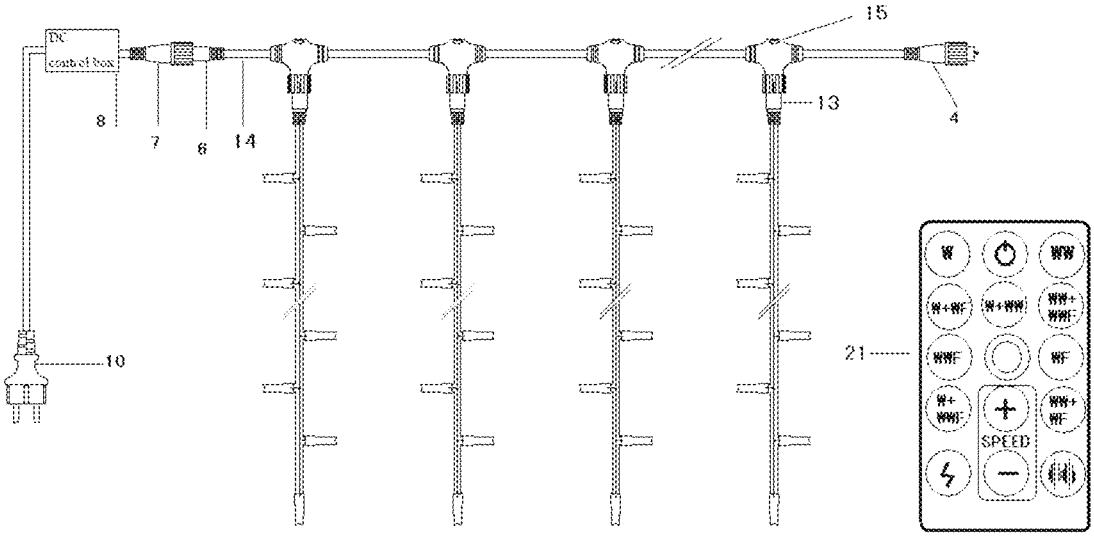
Figures 2, 3, 4:
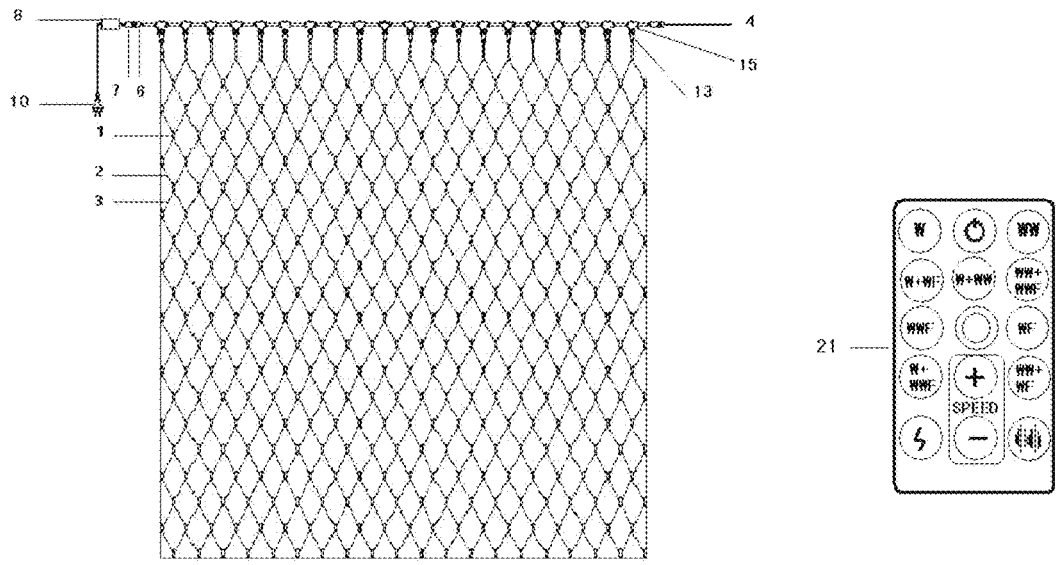
Figure 3:
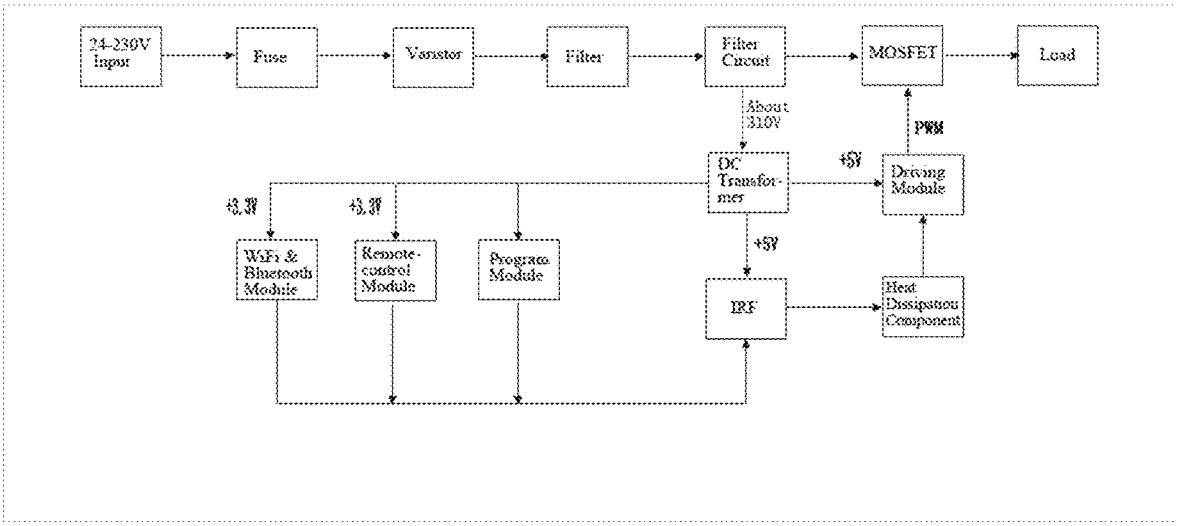
Figure 4:
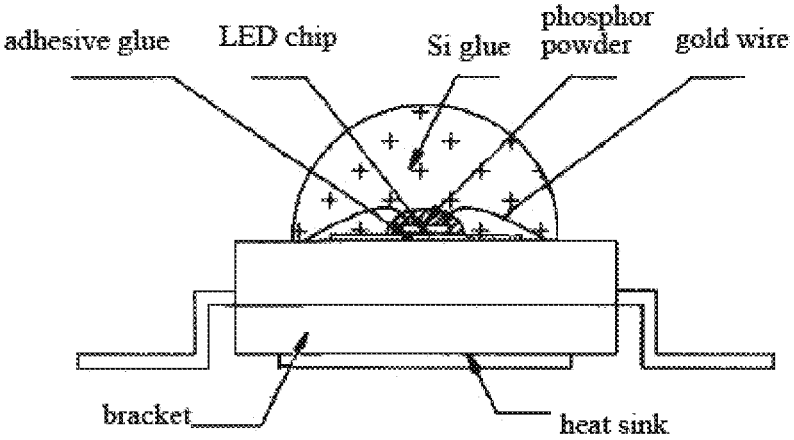
Figure 5:
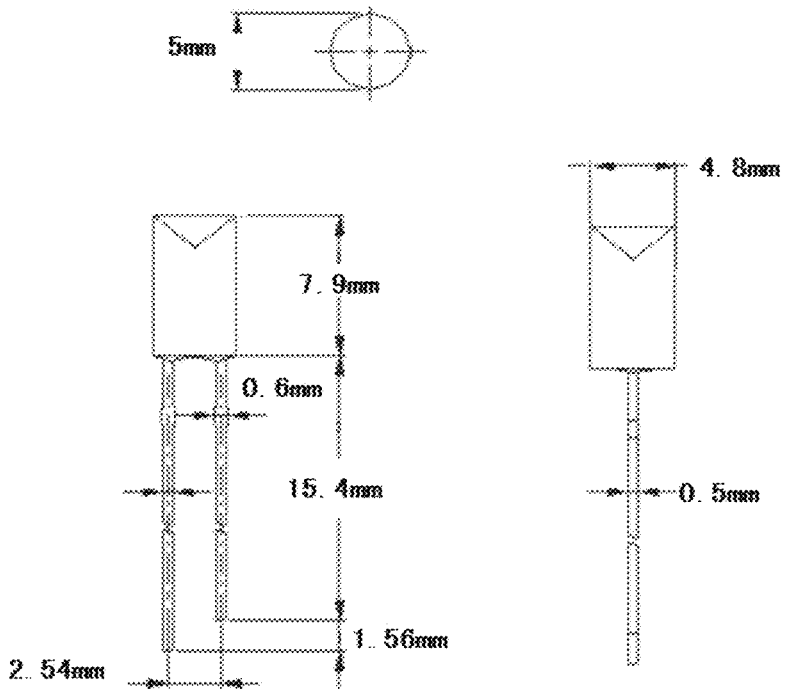
Figure 6:
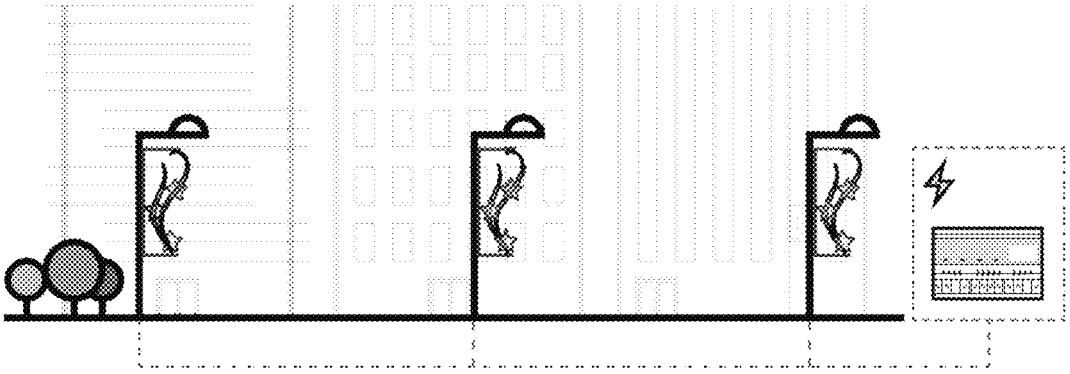
Figure 7:
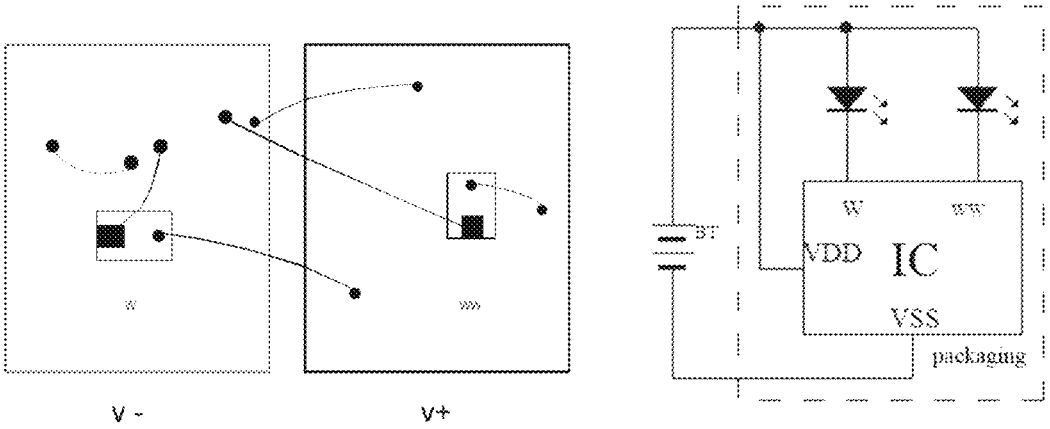

FIG. 1 is a structural schematic diagram of a light string assembly according to an embodiment of the present disclosure;

FIG. 2-1, FIG. 2-2, FIG. 2-3, and FIG. 2-4 are structural schematic diagrams of the general light string, icicle light, curtain light and net light of a white and warm white LED synchronous intelligent light of the present disclosure respectively;

FIG. 3 is a structural schematic diagram according to an embodiment of the present disclosure;

FIG. 4 is a schematic diagram of an internal structure of a white and warm white LED diode;

FIG. 5 is a schematic diagram of a size of a white warm white LED diode;

FIG. 6 is a schematic diagram of synchronization under the same line of a white and warm white LED synchronous intelligent light of the present disclosure;

FIG. 7 is a schematic diagram of white and warm white LED diode wire bonding package;

In which: 1 wire cathode; 2 wire anode; 3 white and warm white LED diode; 4 female joint of the product; 5 wire of the product; 6 male joint of the product; 7 female joint of the controller; 8 controller; 9 waterproof rubber ring; 10 power plug; 13 joint of curtain light string; 14 main wire of curtain light; 15 light holder; 21 remote control.

THE EMBODIMENT OF THE INVENTION

Detailed Description

The present disclosure is further described in combination with the following embodiments and the accompanying drawings so as to help the skilled in the art to better understand and practice the disclosure. However, the embodiments set forth herein should not be regarded as limitation of the present disclosure.

As shown in FIG. 1, FIG. 2-1, FIG. 2-2, FIG. 2-3, and FIG. 2-4, a white and warm white LED synchronous intelligent light string assembly includes an intelligent power supply, a plurality of light strings and a main wire, and the plurality of light strings are connected in parallel to the main wire.

In an embodiment of the disclosure, a plurality of light strings 1 are connected in parallel to a main wire 2. The plurality of light strings 1 extend downward and vertically and are evenly spaced along the main wire 2. Each light string 1 comprises of a plurality of white and warm white LED diodes 3 connected in series. The longest light string is located in the middle of the wire 2 and the light strings of both sides are shorter in length in sequence as being away from the longest light string. A male joint 4 is arranged on one end of the main wire 2 and a female joint 5 is arranged on the other end of the main wire 2. APE heat shrinkable sleeve 6 is arranged outside each of the male joint 4 and female joint 5.

In another embodiment of the disclosure, the plurality of light strings 1 are connected in series to form an elegant curtain-like appearance.

As shown in FIGS. 2 and 3, a first end of a plug 7 is electrically connected to a 24-230 V power supply and a second end of the plug 7 is connected to a control unit. The control unit comprises, in sequence, a fuse for current limitation, a varistor for voltage control, a filter for filtering out noise and separating signals, and a filter circuit for passing the low frequencies and attenuating the high frequencies; outputs of the filter circuit are respectively connected to an input of the MOSFET and a DCDC transformer. The DCDC transformer outputs a direct current with an altered voltage to a driver and an IRF. The IRF is connected with a program module, a remote-control module, and a WiFi & Bluetooth module; these modules are all configured with switches. An output signal from the IRF goes through a heat dissipation component and the driving module. Both of outputs of the driving module and the DCDC transformer are connected to an input of MOSFET while an output of MOSFET is connected to one end of the main wire.

According to an embodiment, the fuse functions as below: when the circuit malfunctions or creates anomalies, the current keeps rising and it probably destroys some crucial devices or expensive devices in the circuit. Consequently, the circuit probably bums out or even a fire can be caused. If a fuse is properly arranged, it will melt when the current abnormally increases to a certain level within a certain time, and thereby interrupting the current and allowing safe operation of the circuit.

The fuse is connected to the varistor via a circuit board and the varistor is a protective device for voltage limitation. With the non-linear characteristic of the varistor, it can clamp the voltage to a certain value when overvoltage is applied thereon in order to protect the subsequent circuit.

The varistor is connected to the filter via the circuit board. The filter is a circuit or an operating and processing system that is capable of frequency selection, and plays a role in filtering noise and separating a variety of signals.

According to an embodiment of the present disclosure, the filter is a circuit or an operating and processing system that is capable of frequency selection and plays a role in filtering noise and separating a variety of signals. Via the circuit board, the filter is connected to the filter circuit which is configured for allowing passing a current with a certain frequency or attenuating a current with a certain frequency. There are four basic filtering circuits: high-pass filter (high frequencies are passed, low frequencies are attenuated), low-pass filter (low frequencies are passed, high frequencies are attenuated), band-pass filter (only frequencies in a frequency band are passed) and band-stop (trap) filter (only frequencies in a frequency band are attenuated).

According to an embodiment of the present disclosure, the filter circuit is connected to the DCDC transformer via the circuit board. Specifically, the input direct current is converted to an alternating current through a self-oscillating circuit, and further converted to a direct current at an altered voltage transformed by the transformer for output, or further converted to a high-voltage direct current by a voltage doubling rectifier circuit for output.

The DCDC transformer converts the input direct current to an alternating current through a self-oscillating circuit, and further converted to a direct current at an altered voltage transformed by the transformer for output, or further converted to a high-voltage direct current by a voltage doubling rectifier circuit for output.

According to an embodiment of the present disclosure, the DCDC transformer is connected to the IRF via the circuit board. There are two main types of field-effect transistors. For metal-oxide semiconductor FET, MOS-FET for short, majority carriers participate in conducting, so it is also named as unipolar transistor, which belongs to a voltage-controlled semiconductor device and has advantages such as high input resistance (1-10Ω), low noise and low power-consumption, wide dynamic range, great facility for integration, and wide safe operating region without second breakdown.

The DCDC transformer is connected to a WiFi & Bluetooth module, a remote-control module and a program module via the circuit board. The WiFi & Bluetooth module is a PCBA integrating functions of WiFi and Bluetooth for short-range wireless communication, and it is composed of a data module and a vocal module. The WiFi & Bluetooth module is mainly used in the field of short-range data transmission and it is handy to be connected with a Bluetooth or WiFi device of a PC, a phone and a tablet computer to avoid tedious cable connecting and to take the place of serial link. The remote-control module is configured for controlling and function switching transmission while the program module refers to the component for editing or correcting the functional program file of the product.

Outputs of the WiFi & Bluetooth module, the remote-controlling module and the program module are connected to the IRF via the circuit board.

Output of the IRF is connected to the heat dissipation component configured as a temperature protection assembly.

Outputs of the DCDC transformer and the heat dissipation component are connected to an input of the driver which is configured for simulating the upper level module of the module to be test and is equivalent to the main program of the module to be test. An output of the driving module is connected to the MOSFET via the circuit board and an output of the MOSFET is connected to the load, wherein the MOSFET is a field-effect diode widely used in analog and digital circuits.

As shown in FIG. 3, the DCDC transformer converts an alternating current to a direct current.

As also shown in FIG. 3, the WiFi & Bluetooth module is controlled via a wireless terminal.

According to an embodiment of the present disclosure, one of the switches of program module, remote-control module and the WiFi & Bluetooth module is turned off, and a closed circuit is formed.

As shown in FIG. 4, it shows the internal structure of a white and warm white LED diode. The LED is composed of chip, adhesive glue, SI glue, phosphor powder, gold wire, bracket and heat sink.

As shown in FIG. 5, it shows a size of a white warm white LED diode. An outer diameter of the bottom of the LED glue is 5MM, an outer diameter of the top of the LED glue is 4.8MM, the relevant dimensions of the bracket: width 0.6MM, thickness 0.5MM, length 15.4MM, 17MM, and the distance between the brackets is 2.54MM.

As shown in FIG. 6, under the same power line, the product maintains the synchronization effect regardless of how long the product is operating. The number of connected products is unlimited.

As shown in FIG. 7, the white and warm white LED is a two-pin light bead that uses control IC and LED chip packaging technology, two kinds of LED chips which are white LED chip and warm white LED chip being packaged inside the light bead, and the control IC is capable of controlling different flashing modes of the LED chips after receiving a command.

Example 1: the white and warm white LED synchronous intelligent light string assembly has 100 bulbs, every 50 bulbs is one closed circuit, and there are two closed circuits in total. The effect is as follows:

1. Functions of Buttons:

Switch. Steady White. Steady Warm White. White+White Flashing. Warm White+Warm White Flashing. White+Warm White Flashing.

Steady Light Warm White (the intermediate color between white and warm white is always on) Warm White All Flashing.

White All Flashing. Warm White+White Flashing. One On and One Off. Gradually lighter and gradually darker. Speed Control.

Automatic Color Changing Function.

1. Switch Function:

The switch is configured to open and close the controller.

2. Steady Function:

When the buttons Steady White, Steady Warm White and Steady Light Warm White are pressed, the white and warm white LED synchronous intelligent light string assembly presents the corresponding steady color.

3. Steady-Plus-Flashing Function:

When the buttons White+White Flashing, Warm White+Warm White Flashing, White+Warm White Flashing and Warm White+White Flashing are pressed, the white and warm white LED synchronous intelligent light string assembly presents the corresponding steady-plus-flashing color.

4. All-Flashing Function:

When the buttons Warm White All Flashing and White All Flashing are pressed, the white and warm white LED synchronized intelligent light string assembly presents the corresponding all-flashing color.

5. Gradually Lighter and Gradually Darker Function:

When the button Gradually lighter and gradually darker is pressed (white/warm white/light warm white), the process of gradually lighter and gradually darker takes 8 seconds, after each color is gradually brighter and darker twice, change to another color.

6. One on and One Off Function:

When the button One On and One Off is pressed (white/warm white/light warm white), it will flash for 15 seconds, and then change to another color.

7. Speed Control Function:

When the speed control button+is pressed, the speed of the corresponding color presented by the white and warm white LED synchronous intelligent light string assembly is increased. When the speed control button−is pressed, the speed of the corresponding color presented by the white and warm white LED synchronous intelligent light string assembly is reduced.

8. Automatic Color Changing Function:

When the button Automatic Color Changing Function is pressed, the white and warm white LED synchronized intelligent light string assembly presents the following functional effects.

(White/Warm White/Light Warm White) Steady color, change a color every 15 seconds.

(White+White Flashing/Warm White+Warm White Flashing/White+Warm White Flashing/Warm White+White Flashing), change a color every 15 seconds.

(White/Warm White/Light Warm White) Gradually lighter and gradually darker, the process of gradually lighter and gradually darker takes 8 seconds. After each color getting gradually lighter and gradually darker twice, change to another color.

(White/Warm White/Light Warm White) One On and One Off, after flashing for 15 seconds, change to another color.

(White Flashing/Warm White Flashing), the color changes every 15 seconds.

9. The above functions are divided into remote control and non-remote control. This function can be programmed and modified arbitrarily through computer programs. Under the same power line, the product maintains a synchronization effect no matter how long it operates after being powered on.

Example 2: the white and warm white LED synchronous intelligent light string assembly has 100 bulbs, every 50 bulbs is one closed circuit, and there are two closed circuits in total.

The Effect is as Follows:

Automatic circulation function of the product:

Steady Warm White for 30 seconds. Warm White+Warm White Flashing for 30 seconds, Steady White for 30 seconds, White+White Flashing for 30 seconds, Warm White All Flashing for 30 seconds, White All Flashing for 30 seconds, Steady White+Warm White for 1020 seconds. Then the above functions will automatically cycle.

This function can be programmed and modified arbitrarily through computer programs. Under the same power line, the simultaneous power supply will be synchronized no matter how long it takes.

The above-mentioned embodiments are only preferred embodiments for fully explaining the present disclosure, and the protection scope of the present disclosure is not limited thereto. Equivalent substitutions or alterations made by those skilled in the art on the basis of the present disclosure are all within the protection scope of the present disclosure. The protection scope of the present disclosure is subject to the claims.

What is claimed is:

1. A white and warm white LED synchronous intelligent light string assembly, comprising an intelligent power supply, a plurality of light strings and a main wire, wherein the plurality of light strings are connected in parallel to the main wire, a male joint and a female joint are respectively arranged on each end of the main wire, the intelligent power supply comprises a plug, a controller and a female terminal of a power wire that are connected in sequence by electric wires, and the female terminal of the power wire is connected to the male joint, and a first end of the plug is connected to a 24-230V power supply, a second end of the plug is sequentially connected to the controller's filter for filtering out noise and separating signals and a filter circuit for attenuating high frequencies and passing low frequencies; outputs of the filter circuit are respectively connected to an input of a MOSFET and a DCDC transformer, the DCDC transformer outputs an direct current with an altered voltage to the driver and the IRF which is connected to a program module, wherein an input synchronous command of the program module for controlling the white and warm white LED synchronous intelligent light string assembly is converted to an output signal after being processed by the IRF, and the output signal arrives to the input of the driving module through the heat dissipation component, further arrives to the input of the MOSFET and then to the plurality of light strings, with outputs of the driving module and the DCDC transformer connected to the input of the MOSFET.

2. The white and warm white LED synchronous intelligent light string assembly of claim 1, wherein under a same power line, the product maintains a synchronization effect no matter how long it operates after being powered on, and the number of connected light strings is unlimited.

3. The white and warm white LED synchronous intelligent light string assembly of claim 2, wherein synchronous switch of the plurality of light strings is performed by the remote-control module and the WiFi & Bluetooth module through a wireless terminal.

4. The white and warm white LED synchronous intelligent light string assembly of claim 1, wherein a white and warm white LED has a synchronization function, the white and warm white LED is a two-pin light bead that uses control IC and LED chip packaging technology, two kinds of LED chips which are white LED chip and warm white LED chip being packaged inside the light bead, and the control IC is capable of controlling different flashing modes of the LED chips after receiving a command.

5. The white and warm white LED synchronous intelligent light string assembly of claim 1, wherein the IRF is connected to a remote-control module and a WiFi & Bluetooth module.

6. The white and warm white LED synchronous intelligent light string assembly of claim 1, wherein the light string comprises a general light string, an icicle light, a curtain light or a net light, and the plug is an IP44 plug.

7. The white and warm white LED synchronous intelligent light string assembly of claim 1, each of the plurality of light strings comprises a plurality of white and warm white LED diodes connected in series, wherein each of the plurality of white and warm white LED diodes comprises a LED bulb and a PC housing, a chip is arranged inside the LED bulb and the LED bulb is capsulated in the PC housing by an epoxy resin.

8. The white and warm white LED synchronous intelligent light string assembly of claim 1, each of the plurality of white and warm white LED diodes has an outer diameter of 3 mm, 4 mm, 5 min or 8 mm.

* * * * *